US005448808A

United States Patent [19]

Gross

[11] Patent Number: 5,448,808

[45] Date of Patent: Sep. 12, 1995

[54] FOLDABLE ZIPPER SLIDER WITH IMPROVED COMPRESSION-TYPE LATCH

[75] Inventor: Jon Gross, Canandaigua, N.Y.

[73] Assignee: Mobil Oil Corporation, Fairfax, Va.

[21] Appl. No.: 262,714

[22] Filed: Jun. 20, 1994

[51] Int. Cl.[6] ..... A44B 19/00

[52] U.S. Cl. ..... 24/400; 24/418; 24/427; 24/430

[58] Field of Search ..... 24/400, 399, 587, 389, 24/430, 427, 418; 383/63, 65, 69

[56] References Cited

U.S. PATENT DOCUMENTS 3,713,923 1/1973 Laguerre ..... 24/427
5,007,143 4/1991 Herrington ..... 24/400
5,010,627 4/1991 Herrington et al. ..... 24/400
5,063,644 11/1991 Herrington et al. ..... 24/400
5,067,208 11/1991 Herrington et al. ..... 24/400
5,070,583 12/1991 Herrington ..... 24/430

*Primary Examiner*—Victor N. Sakran
*Attorney, Agent, or Firm*—Alexander J. McKillop; Malcom D. Keen; L. Gene Wise

[57] ABSTRACT

A plastic zipper slider having hinged wings is provided with an improved latch tongue which is deflected downward to snap in place. Additional flexible latch web structure cooperates with the latch tongue to provide additional forces which are active in assuring that the wings are fully latched and to also provide additional resistance to unlatching the wings.

4 Claims, 4 Drawing Sheets

FOLDABLE ZIPPER SLIDER WITH IMPROVED COMPRESSION-TYPE LATCH

BACKGROUND OF THE INVENTION

The present invention relates to improvements in plastic sliders for opening and closing plastic reclosable fasteners or zippers on plastic bags and the like and particularly to improvements in a compression-type latch for one-piece "gull-wing" type foldable plastic sliders for profiled plastic reclosable fasteners or zippers on plastic bags.

The present invention is an improvement on the compression-type latch for the foldable zipper slider disclosed and claimed in U.S. Pat. No. 5,063,644—Herrington et al. and in U.S. Pat. No. 5,067,208—Herrington et al. both assigned to the same assignee as the present application. The aforesaid patent discloses a one-piece foldable plastic zipper slider for straddling relation with a profiled plastic reclosable fastener. The plastic zipper slider was provided with hinged wings that are latched in place by a latch tongue which is deflected downward to snap in place to prevent it from being re-opened. The present invention is directed to a provision of additional flexible latch web structure which cooperates with the latch tongue to provide additional forces which are active in assuring that the wings are fully latched and to also provide additional resistance to unlatching the wings.

SUMMARY OF THE INVENTION

It is an object of the present invention to provide a one-piece foldable plastic zipper slider with an improved compression-type latch.

The present invention relates to a foldable plastic slider with a compression-type latch for straddling relation with a profiled plastic zipper. The straddling slider for closing or opening the zipper by movement therealong comprises a transverse support member having a pair of legs depending from opposite sides of the support member. A pair of sidewalls are hinged to the opposite sides of said support member on opposite sides of the respective legs. The sidewalls are foldable relative to each other and have openings therein for receiving the depending legs. Means is provided for interlocking the sidewalls to the depending legs comprising shoulder structure extending along an edge of each of the depending legs and flexible tongue structure extending along a corresponding edge in each of the sidewalls. Flexible web structure is provided at the ends of the flexible tongue structure connecting the ends to the respective sidewalls and for holding the flexible tongue structure in spaced relation to the sidewalls. The flexible tongue structure and the flexible web structure are depressible by the edge of the depending legs when the sidewalls are moved to folded position and the flexible tongue structure is adapted to snap into engagement with the respective shoulders on the legs. The flexible web structure when depressed acts to force the flexible tongue structure outwardly from the sidewalls into a fully locked condition with the respective shoulders on the legs to provide an improved compression-type latch for locking the sidewalls in their folded position on the zipper. The sidewalls have shoulder structure on the bottom thereof for cooperating with the bottom of the zipper to prevent the slider from being lifted off the zipper while the slider straddles the zipper and the flexible web structure when in tension provides a resistive force to maintain the flexible tongue structure in locked condition and prevent movement of the sidewalls from their folded position.

PREFERRED EMBODIMENT OF THE INVENTION

Figure 1:
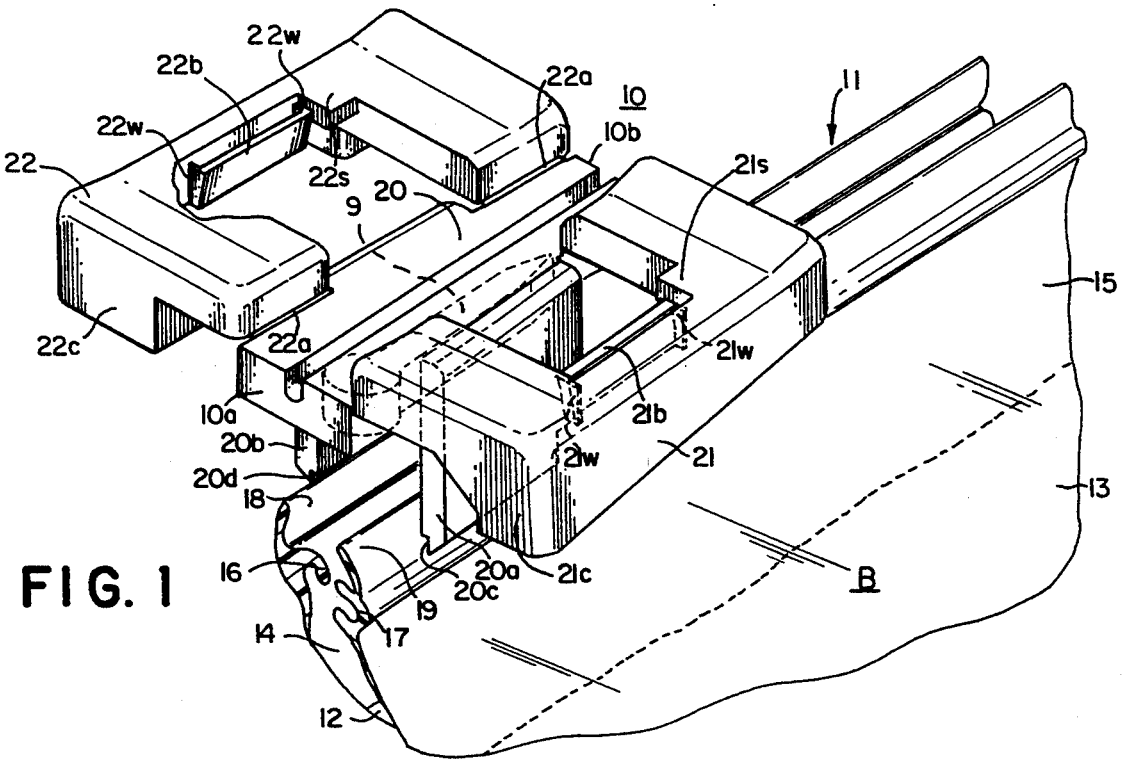
FIG. 1 a perspective view of a foldable plastic slider embodying the present invention shown in open position and illustrating the method of assembling the foldable plastic slider with a profiled plastic reclosable fastener or zipper in accordance with the present invention.

Referring to FIG. 1 there is illustrated a plastic slider 10 and profiled plastic reclosable fastener or zipper 11 embodying the present invention. The slider 10 and zipper 11 are particularly suited for thermoplastic bags and the like and the slider 10 has been illustrated in FIGS. 1 and 2 assembled on the zipper 11 at the top edge or mouth of the thermoplastic bag B. The bag B (partially shown) may be made from any suitable thermoplastic film such for example as polyethylene or polypropylene or equivalent material. The bag B is formed by a pair of flexible plastic sheets 12 and 13 joined at the bottom and having a top edge, with a pair of flexible plastic strips 14 and 15 having separable plastic means extending along the length thereof comprising reclosable interlocking male and female profile elements in the form of rib and groove elements 16 and 17 on the respective strips to form the zipper 11. The examples of the bag and zipper are more fully described in the aforesaid U.S. Pat. Nos. 5,063,644 and 5,067,208 and in U.S. Pat. No. 5,007,143—Herrington.

Figure 2:
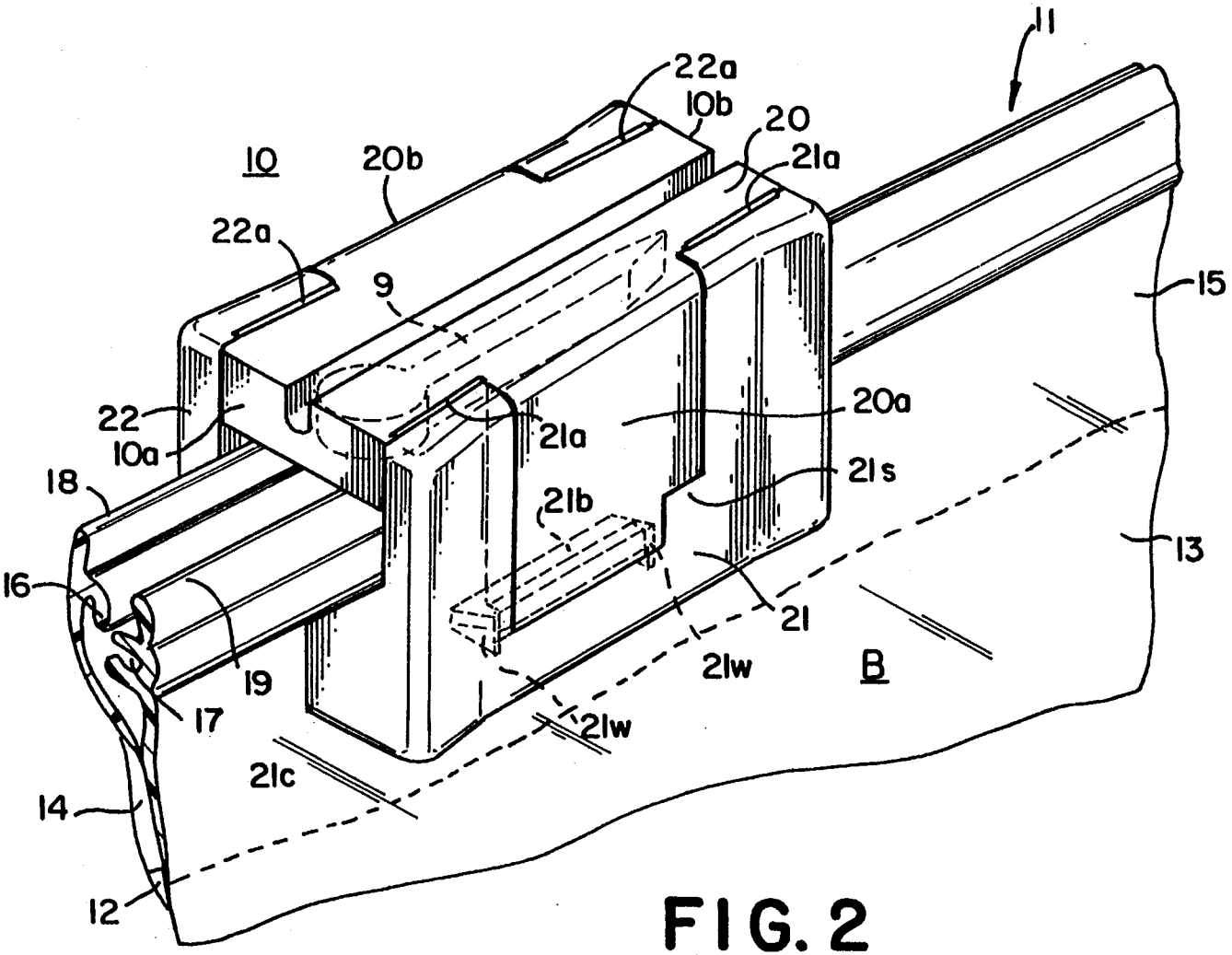
FIG. 2 is a perspective view of the foldable plastic zipper of FIG. 1 assembled on the profiled plastic reclosable fastener or zipper with the foldable wings of the slider snapped into closed position.

As may be seen in FIGS. 1 and 2 the slider 10 straddles the zipper 11 at the top of the bag B and is adapted for opening or closing the reclosable fastener elements 16 and 17 of the zipper 11. The slider 10 is formed from a single piece of molded plastic comprising a separator finger 9 and interlocking complementary structure movable along the zipper 11. The separator finger 9 is more fully described and claimed in the aforesaid U.S. Pat. No. 5,067,208. The slider 10 may be molded from any suitable plastic such for example as nylon, polypropylene, polystyrene, Delrin or ABS.

The complementary structure comprises an inverted U-shaped member including a transverse support member or body 20 from which the separator finger 9 depends. The body 20 is itself U-shaped and includes two integral depending legs 20*a*, 20*b*. The finger 9 is positioned between the legs 20*a*, 20*b*. The body 20 is adapted to move along the top edges of the tracks 18 and 19 with the legs 20*a*, 20*b* straddling these elements and the finger 9 positioned between the tracks 18 and 19. The body 20 includes a pair of hinged "wings" or sidewalls 21 and 22 that can be folded down into their final position. The wings 21 and 22 are hinged to the main slider body 20 by means of hinge structure 21*a* and 22*a* located at the opposite ends of the legs 20*a* and 20*b*. The wings 21 and 22 have central openings into which the legs 20*a*, 20*b* extend when the wings 21 and 22 are folded down into their final position as hereinafter to be described. The hinge structure 21*a* and 22*a* is a relatively thin section of the plastic material as compared to the wall thicknesses of the wings 21 and 22 and the flexibility of the plastic material makes possible the use of the integral hinge structure 21*a* and 22*a* which is sometimes referred to as a "living" hinge.

Figure 3:
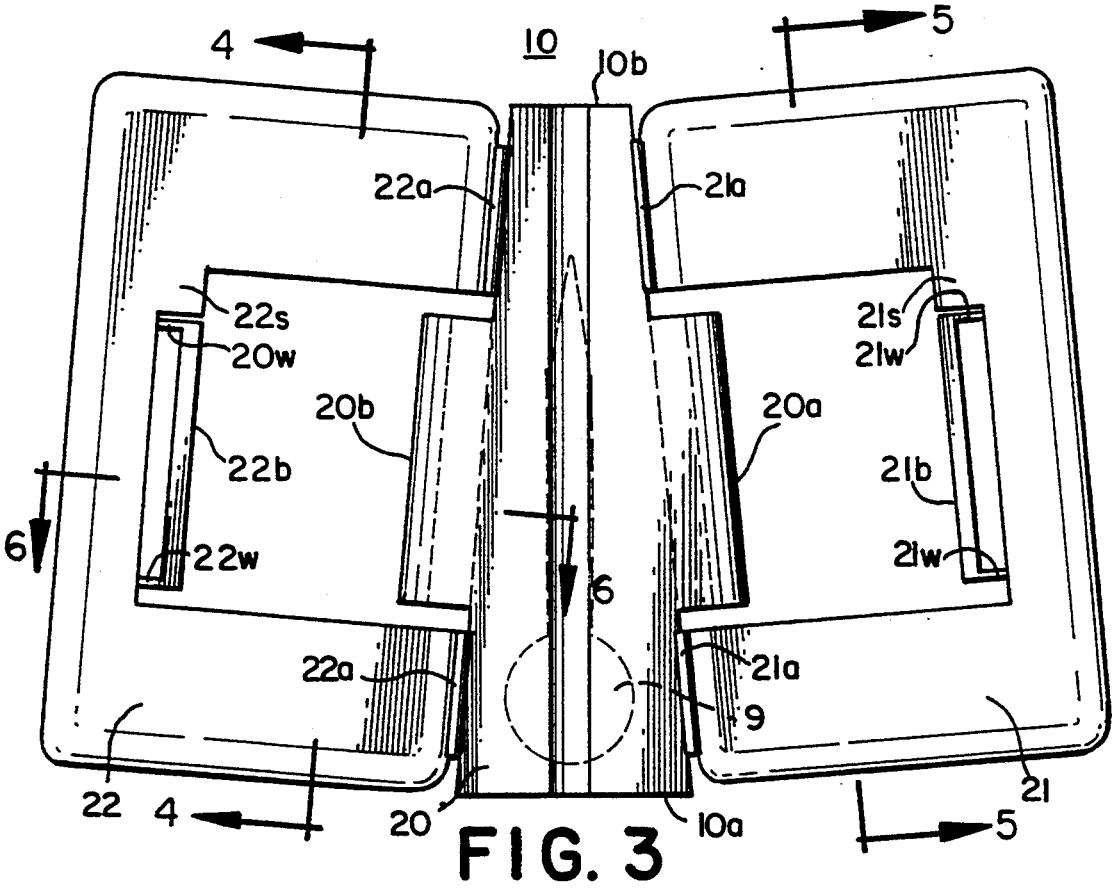
FIG. 3 is a top plan view of the foldable plastic slider shown in FIG. 1.
Figure 4:
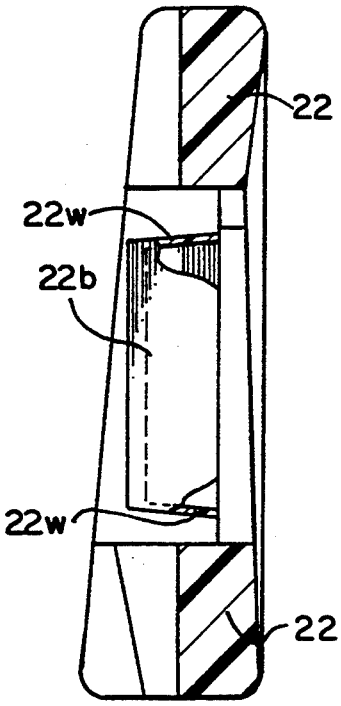
FIG. 4 is a sectional view taken along the lines 4—4 in FIG. 3.
Figure 6A:
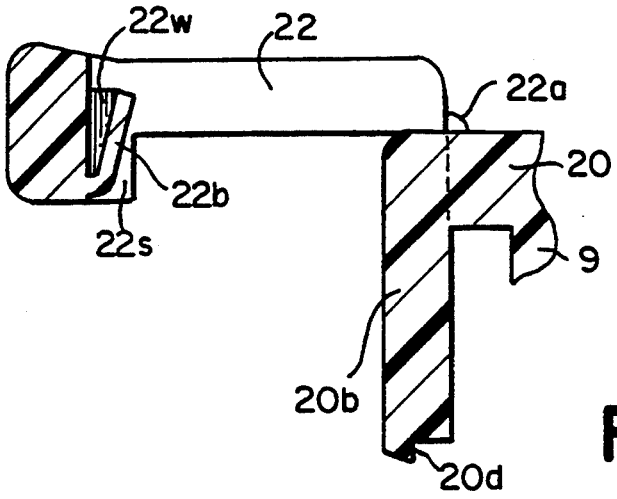
FIG. 6*a* is a sectional view taken along the lines 6—6 in FIG. 3
Figure 6B:
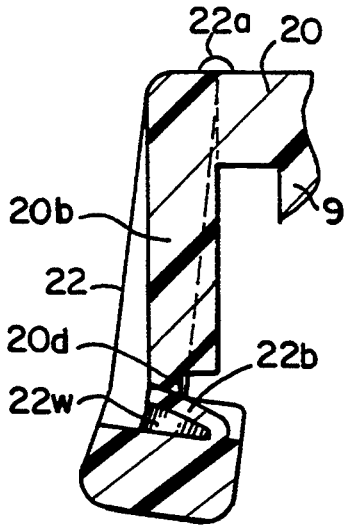
FIG. 6*b* is a sectional view similar to FIG. 6*a* with the foldable wing rotated downwardly into a partially assembled position.
Figure 6C:
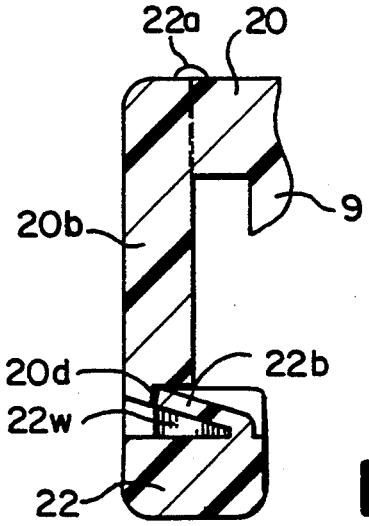
FIG. 6*c* is a sectional view similar to FIGS. 6*a* and 6*b* with the foldable wing fully rotated to the assembled position with the compression-latch snapped closed.

When the wings 21 and 22 are folded down to their final sidewall position from the open wing position shown in FIGS. 1, 3 and 6*a*, to the folded sidewall position shown in FIGS. 2 and 6*c*, the sidewalls 21 and 22 are held in fixed position by the improved compression-type slider latch which is of novel construction as now to be described. As may be seen in FIGS. 1, 3, 4 and 6*a*–6*c* the wing 22 is provided adjacent its outer end with a flexible tongue 22*b*. Flexible web structure 22*w* is provided at the ends of the flexible tongue structure 22*b*, FIG. 4, connecting the ends to the sidewall 22. The lower end of the leg 20*b* is provided with an angled surface adjacent latching shoulder 20*d*. When the wing 22 is rotated in a counterclockwise direction from the position in FIG. 6*a* to the position in FIG. 6*b*, the flexible tongue 22*b* will be deflected downward by the angled surface on the lower end of the leg 20*b* as illustrated in FIG. 6*b* and when the wing 22 is in the vertical position as shown in FIG. 6*c*, the flexible tongue 22*b* will have snapped in place and moved into engagement with the shoulder 20*d* at the lower end of leg 20*b*. When the flexible tongue 20*b* engages the angled surface adjacent the latching shoulder 20*d*, the flexible tongue 22*b* as well as the flexible web structure 22*w* are depressed until the flexible tongue structure 22*b* snaps into engagement with the shoulder 20*d*. The flexible web structure 22*w* when depressed and acts similar to a spring in compression to force the flexible tongue 22*b* outwardly from the sidewall 22 into a fully locked condition with the shoulder 20*d* on the leg 20*b*. This spring action provided by the latching webs 22*w* assures that the sidewall 22 is fully latched and will not pop open. This compression force provided by the latching webs 22*w* also is used to advantage in the assembly machine when the sidewalls of the slider are being closed onto the zipper track. The wing 22 may be provided with a stop member 22*s*, FIGS. 1, 3, and 6*a*, which is adapted to engage a cooperating stop member (not shown) adjacent the lower end of leg 20*b*. When the wing 22 has moved from the open position of FIG. 6*a* to the latched position in FIG. 6*c*, the stop on the wing will engage the stop on the leg thereby preventing the wing 22 from being moved beyond its latched position thus preventing its over-travel from interfering with the latching of opposing wing 21. This is more fully disclosed in the aforesaid U.S. Pat. No. 5,067,208. Once the latch has been engaged, it cannot be disengaged without breaking it. As it is being latched, the tongue 22*b* deflects downward as shown in FIG. 6*b*. However, when attempting to disengage it, the direction in which the force acts on it exerts a component to force it more strongly into engagement with the shoulder 20*d*, FIG. 6*c*. The flexible web structure 22*w* resists the motion of the latch tongue 22*b* away from the sidewall 20*b* placing the web 22*w* in tension. This resistance is similar to a spring in tension and thus makes it more difficult to pull the slider apart, thereby increasing the strength of the latch which in turn requires a greater force to break it. This is an additional safety feature with regard to children in preventing them from removing the slider from the zipper.

Figure 5:
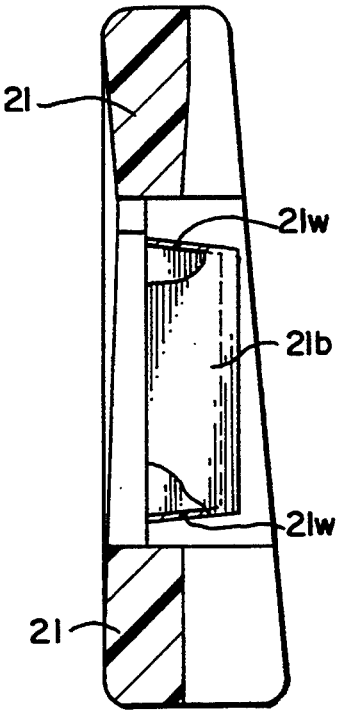
FIG. 5 a sectional view taken along the lines 5—5 in FIG. 3.

It is to be understood that the other wing 21 likewise has a flexible tongue 21*b* which is adapted to engage a shoulder 20*c*, FIG. 1, at the lower end of the leg 20*a* so as to provide a compression-type latch and lock the wing 21 in place. The flexible tongue 21*b* also has flexible web structure 21*w* at the opposite ends thereof, FIG. 5, which cooperate with the flexible tongue 21*b* in the same manner as described in connection with the flexible tongue 22*b*. The wing 21 may also be provided with a stop 21*s* which is adapted to engage a cooperating stop (not shown) adjacent the lower end of leg 20*a*. The stop 21*s* functions in the same manner as stop 22*s* described above.

While a preferred embodiment of the invention has been described and illustrated, it is to be understood that further modifications thereof may be made within the scope of the appended claims without departing from the spirit of the invention.

What is claimed is:

1. A foldable plastic slider with compression-type latch for straddling relation with a profiled plastic zipper, the straddling slider for closing or opening the zipper by movement therealong comprising a transverse support member having a pair of legs depending from opposite sides of said support member, a pair of sidewalls hinged to the opposite sides of said support member on opposite sides of the respective legs, said sidewalls being foldable relative to each other and having openings therein for receiving said depending legs, and means for interlocking said sidewalls to said depending legs comprising shoulder structure ending along an edge of each of said depending legs and flexible tongue structure extending along a corresponding edge in each of said sidewalls, flexible web structure at the ends of said flexible tongue structure connecting said ends to the respective sidewalls and for holding said flexible tongue structure in spaced relation to said sidewalls, said flexible tongue structure and said flexible web structure being depressible by the edge of said depending legs when said sidewalls are moved to folded position and said flexible tongue structure being adapted to snap into engagement with the respective shoulders on said legs, said flexible web structure when depressed acting to force said flexible tongue structure outwardly from said sidewalls into a fully locked condition with the respective shoulders on said legs to provide an improved compression-type latch for locking said sidewalls in their folded position on said zipper.

2. A foldable plastic slider according to claim 1 wherein said sidewalls have shoulder structure on the bottom thereof for cooperating with the bottom of the zipper to prevent the slider from being lifted off the zipper while the slider straddles the zipper and said flexible web structure when in tension provides a resistive force to maintain said flexible tongue structure in locked condition and prevent movement of said sidewalls from their folded position.

3. A foldable plastic slider according to claim 1 wherein said shoulder structure extends along the lower end of each of said depending legs, and said flexible tongue structure extends along the lower end of the openings in each of said sidewalls and both said flexible tongue structure and said flexible web structure being depressible by the lower ends of said depending legs.

4. A foldable plastic slider according to claim 1 including a separator finger depending from said transverse support member and positioned between said pair of legs depending from said support member.

* * * * *

UNITED STATES PATENT AND TRADEMARK OFFICE

CERTIFICATE OF CORRECTION

PATENT NO. : 5,448,808

DATED : September 12, 1995

INVENTOR(S) : Jon Gross

It is certified that error appears in the above-identified patent and that said Letters Patent is hereby corrected as shown below:

In Fig. 3, reference numeral 20W should be changed to 22W

Signed and Sealed this

Twenty-first Day of March, 2000

*Attest:*

*Attesting Officer*

Q. TODD DICKINSON

*Commissioner of Patents and Trademarks*